US007823359B2

(12) United States Patent
Pervan

(10) Patent No.: US 7,823,359 B2
(45) **Date of Patent: *Nov. 2, 2010**

(54) FLOOR PANEL WITH A TONGUE, GROOVE AND A STRIP

(75) Inventor: Tony Pervan, Solna (SE)
(73) Assignee: Valinge Innovation AB, Viken (SE)

( * ) Notice: Subject to any disclaimer, the term of this patent is extended or adjusted under 35 U.S.C. 154(b) by 0 days.
This patent is subject to a terminal disclaimer.

(21) Appl. No.: 11/509,718
(22) Filed: Aug. 25, 2006
(65) Prior Publication Data
US 2006/0283127 A1 Dec. 21, 2006
Related U.S. Application Data
(63) Continuation of application No. 10/202,093, filed on Jul. 25, 2002, which is a continuation of application No. 09/534,007, filed on Mar. 24, 2000, now Pat. No. 6,516,579, which is a continuation of application No. 09/356,563, filed on Jul. 19, 1999, now Pat. No. 6,182,410, which is a continuation of application No. 09/193,687, filed on Nov. 18, 1998, now Pat. No. 6,023,907, which is a continuation of application No. 09/003,499, filed on Jan. 6, 1998, now Pat. No. 5,860,267, which is a continuation of application No. 08/436,224, filed as application No. PCT/SE94/00386 on Apr. 29, 1994, now Pat. No. 5,706,621.
(30) Foreign Application Priority Data
May 10, 1993 (SE) ..... 9301595
(51) Int. Cl.
*E04B 2/00* (2006.01)
(52) U.S. Cl. ..... 52/588.1; 52/390; 52/539; 52/592.2; 428/50
(58) Field of Classification Search ..... 52/586.1, 52/586.2, 589.2, 478, 482, 403.1, 480, 592.1, 52/592.2, 591.3, 591.4, 512, 582.2, 583.1, 52/584.1, 578, 582.1, 579, 390, 392, 533, 52/534, 539, 553, 588.1, 589.1, 590.2, 590.3, 52/591.1, 591.5, 592.4, 745.09, 745.19, 747.1, 52/747.11, 748.1, 748.11; 403/334, 345, 403/364–368, 372, 375, 376, 381; 404/34, 404/35, 40, 41, 46, 47, 68, 70; 428/44, 47–50, 428/57, 58, 61, 106, 192–294
See application file for complete search history.

(56) References Cited
U.S. PATENT DOCUMENTS
213,740 A 4/1879 Conner
(Continued)
FOREIGN PATENT DOCUMENTS
AT 218725 B 12/1961
(Continued)
OTHER PUBLICATIONS
Webster's Dictionary, Random House: New York (1987), p. 862.
Knight's American Mechanical Dictionary, Hurd and Houghton: New York (1876), p. 2051.
(Continued)

*Primary Examiner*—Richard E Chilcot, Jr.
*Assistant Examiner*—William V Gilbert
(74) *Attorney, Agent, or Firm*—Buchanan Ingersoll & Rooney PC

(57) ABSTRACT

Floorboards with substantially planar and parallel upper top sides and lower undersides and panel material located between the upper and lower top sides, and a mechanical locking system for locking a first edge of a first floor board to a second edge of a substantially identical second floor board, the mechanical locking system including a tongue and groove forming a first mechanical connection locking the first and second edges to each other in a first direction at right angles to a principal plane of the floor boards, and a locking device forming a second mechanical connection locking the first and the second edges to each other in a second direction and at right angles to the edges; wherein, when the first edge and the second edge are locked together, there is space in the locking system between the first and the second edges.

25 Claims, 6 Drawing Sheets

U.S. PATENT DOCUMENTS

| | | | | | |
|---|---|---|---|---|---|
| 714,987 | A | | 12/1902 | Wolfe | |
| 753,791 | A | | 3/1904 | Fulghum | |
| 1,124,228 | A | | 1/1915 | Houston | |
| 1,194,636 | A | | 8/1916 | Joy | |
| 1,371,856 | A | | 3/1921 | Cade | |
| 1,407,679 | A | | 2/1922 | Ruthrauff | |
| 1,454,250 | A | | 5/1923 | Parsons | |
| 1,468,288 | A | | 9/1923 | Een | |
| 1,477,813 | A | | 12/1923 | Daniels et al. | |
| 1,510,924 | A | | 10/1924 | Daniels et al. | |
| 1,540,128 | A | | 6/1925 | Houston | |
| 1,575,821 | A | | 3/1926 | Daniels | |
| 1,602,256 | A | | 10/1926 | Sellin | |
| 1,602,267 | A | | 10/1926 | Karwisch | |
| 1,615,096 | A | | 1/1927 | Meyers | |
| 1,622,103 | A | | 3/1927 | Fulton | |
| 1,622,104 | A | | 3/1927 | Fulton | |
| 1,637,634 | A | | 8/1927 | Carter | |
| 1,644,710 | A | | 10/1927 | Crooks | |
| 1,660,480 | A | | 2/1928 | Daniels | |
| 1,714,738 | A | | 5/1929 | Smith | |
| 1,718,702 | A | | 6/1929 | Pfiester | |
| 1,734,826 | A | | 11/1929 | Pick | |
| 1,764,331 | A | | 6/1930 | Moratz | |
| 1,778,069 | A | | 10/1930 | Fetz | |
| 1,787,027 | A | | 12/1930 | Wasleff | |
| 1,790,178 | A | | 1/1931 | Sutherland, Jr. | |
| 1,823,039 | A | | 9/1931 | Gruner | |
| 1,859,667 | A | | 5/1932 | Gruner | |
| 1,809,393 | A | | 6/1932 | Rockwell | |
| 1,898,364 | A | * | 2/1933 | Gynn | 52/512 |
| 1,906,411 | A | | 5/1933 | Potvin | |
| 1,929,871 | A | | 10/1933 | Jones | |
| 1,940,377 | A | | 12/1933 | Storm | |
| 1,953,306 | A | | 4/1934 | Moratz | |
| 1,986,739 | A | | 1/1935 | Mitte | |
| 1,988,201 | A | | 1/1935 | Hall | |
| 1,995,264 | A | | 3/1935 | Mason | |
| 2,026,511 | A | | 12/1935 | Storm | |
| 2,044,216 | A | | 6/1936 | Klages | |
| 2,266,464 | A | | 12/1941 | Kraft | |
| 2,269,926 | A | | 1/1942 | Crooks | |
| 2,276,071 | A | | 3/1942 | Scull | |
| 2,324,628 | A | | 7/1943 | Kähr | |
| 2,398,632 | A | | 4/1946 | Frost et al. | |
| 2,430,200 | A | | 11/1947 | Wilson | |
| 2,495,862 | A | | 1/1950 | Osborn | |
| 2,740,167 | A | | 4/1956 | Rowley | |
| 2,780,253 | A | | 2/1957 | Joa | |
| 2,805,852 | A | * | 9/1957 | Malm | 266/283 |
| 2,851,740 | A | | 9/1958 | Baker | |
| 2,865,058 | A | | 12/1958 | Andersson et al. | |
| 2,894,292 | A | | 7/1959 | Gramelspacher | |
| 2,928,456 | A | | 3/1960 | Potchen et al. | |
| 2,947,040 | A | | 8/1960 | Schultz | |
| 3,045,294 | A | | 7/1962 | Livezey, Jr. | |
| 3,100,556 | A | | 8/1963 | De Ridder | |
| 3,120,083 | A | | 2/1964 | Dahlberg et al. | |
| 3,125,138 | A | | 3/1964 | Bolenbach | |
| 3,182,769 | A | | 5/1965 | De Ridder | |
| 3,200,553 | A | | 8/1965 | Frashour et al. | |
| 3,203,149 | A | | 8/1965 | Soddy | |
| 3,247,638 | A | | 4/1966 | Gay | |
| 3,267,630 | A | | 8/1966 | Omholt | |
| 3,282,010 | A | | 11/1966 | King, Jr. | |
| 3,301,147 | A | | 1/1967 | Clayton et al. | |
| 3,310,919 | A | | 3/1967 | Bue et al. | |
| 3,347,048 | A | | 10/1967 | Brown et al. | |
| 3,377,931 | A | | 4/1968 | Hilton | |
| 3,387,422 | A | | 6/1968 | Wanzer | |
| 3,440,790 | A | | 4/1969 | Nerem | |
| 3,460,304 | A | | 8/1969 | Braeuninger et al. | |
| 3,481,810 | A | | 12/1969 | Waite | |
| 3,508,523 | A | | 4/1970 | De Meerleer | |
| 3,517,927 | A | | 6/1970 | Kennel | |
| 3,526,420 | A | | 9/1970 | Brancalcone | |
| 3,538,665 | A | | 11/1970 | Gohner | |
| 3,548,559 | A | | 12/1970 | Levine | |
| 3,553,919 | A | | 1/1971 | Omholt | |
| 3,555,762 | A | | 1/1971 | Costanzo, Jr. | |
| 3,579,941 | A | | 5/1971 | Tibbals | |
| 3,694,983 | A | | 10/1972 | Couquet | |
| 3,714,747 | A | | 2/1973 | Curran | |
| 3,720,027 | A | * | 3/1973 | Christensen | 52/309.8 |
| 3,729,368 | A | * | 4/1973 | Ingham | 428/101 |
| 3,731,445 | A | | 5/1973 | Hoffmann et al. | |
| 3,759,007 | A | | 9/1973 | Thiele | |
| 3,768,846 | A | | 10/1973 | Hensley et al. | |
| 3,786,608 | A | | 1/1974 | Boettcher | |
| 3,842,562 | A | * | 10/1974 | Daigle | 52/583.1 |
| 3,857,749 | A | | 12/1974 | Yoshida | |
| 3,859,000 | A | | 1/1975 | Webster | |
| 3,902,293 | A | | 9/1975 | Witt et al. | |
| 3,908,053 | A | | 9/1975 | Hettich | |
| 3,936,551 | A | | 2/1976 | Elmendorf et al. | |
| 3,988,187 | A | | 10/1976 | Witt et al. | |
| 4,037,377 | A | | 7/1977 | Howell et al. | |
| 4,084,996 | A | | 4/1978 | Wheeler | |
| 4,090,338 | A | | 5/1978 | Bourgade | |
| 4,099,358 | A | | 7/1978 | Compaan | |
| 4,100,710 | A | | 7/1978 | Kowallik | |
| 4,169,688 | A | | 10/1979 | Toshio | |
| 4,196,554 | A | | 4/1980 | Anderson et al. | |
| 4,227,430 | A | | 10/1980 | Jansson et al. | |
| 4,242,390 | A | | 12/1980 | Nemeth | |
| 4,299,070 | A | | 11/1981 | Oltmanns et al. | |
| 4,304,083 | A | | 12/1981 | Anderson | |
| 4,426,820 | A | | 1/1984 | Terbrack et al. | |
| 4,471,012 | A | | 9/1984 | Maxwell | |
| 4,489,115 | A | | 12/1984 | Layman et al. | |
| 4,501,102 | A | | 2/1985 | Knowles | |
| 4,561,233 | A | | 12/1985 | Harter et al. | |
| 4,567,706 | A | | 2/1986 | Wendt | |
| 4,612,074 | A | | 9/1986 | Smith et al. | |
| 4,612,745 | A | | 9/1986 | Hovde | |
| 4,641,469 | A | | 2/1987 | Wood | |
| 4,643,237 | A | | 2/1987 | Rosa | |
| 4,646,494 | A | | 3/1987 | Saarinen et al. | |
| 4,648,165 | A | | 3/1987 | Whitehorne | |
| 4,653,242 | A | | 3/1987 | Ezard | |
| 4,703,597 | A | | 11/1987 | Eggemar | |
| 4,715,162 | A | | 12/1987 | Brightwell | |
| 4,716,700 | A | | 1/1988 | Hagemeyer | |
| 4,738,071 | A | | 4/1988 | Ezard | |
| 4,769,963 | A | | 9/1988 | Meyerson | |
| 4,819,932 | A | | 4/1989 | Trotter, Jr. | |
| 4,822,440 | A | | 4/1989 | Hsu et al. | |
| 4,831,806 | A | | 5/1989 | Niese et al. | |
| 4,845,907 | A | | 7/1989 | Meek | |
| 4,905,442 | A | | 3/1990 | Daniels | |
| 5,029,425 | A | | 7/1991 | Bogataj | |
| 5,113,632 | A | | 5/1992 | Hanson | |
| 5,117,603 | A | | 6/1992 | Weintraub | |
| 5,148,850 | A | | 9/1992 | Urbanick | |
| 5,165,816 | A | | 11/1992 | Parasin | |
| 5,179,812 | A | | 1/1993 | Hill | |
| 5,216,861 | A | | 6/1993 | Meyerson | |
| 5,253,464 | A | | 10/1993 | Nilsen | |
| 5,271,564 | A | | 12/1993 | Smith | |
| 5,286,545 | A | | 2/1994 | Simmons, Jr. et al. | |
| 5,295,341 | A | | 3/1994 | Kajiwara | |
| 5,349,796 | A | | 9/1994 | Meyerson | |
| 5,390,457 | A | | 2/1995 | Sjölander | |
| 5,433,806 | A | | 7/1995 | Pasquali et al. | |

5,474,831 A 12/1995 Nystrom
5,497,589 A 3/1996 Porter
5,502,939 A 4/1996 Zadok et al.
5,540,025 A 7/1996 Takehara et al.
5,560,569 A 10/1996 Schmidt
5,567,497 A 10/1996 Zegler et al.
5,570,554 A 11/1996 Searer
5,597,024 A 1/1997 Bolyard et al.
5,613,894 A 3/1997 Delle VeDove
5,618,602 A 4/1997 Nelson
5,630,304 A 5/1997 Austin
5,653,099 A 8/1997 MacKenzie
5,671,575 A 9/1997 Wu
5,695,875 A 12/1997 Larsson et al.
5,706,621 A 1/1998 Pervan
5,755,068 A 5/1998 Ormiston
5,768,850 A 6/1998 Chen
5,797,237 A 8/1998 Finkell, Jr.
5,823,240 A 10/1998 Bolyard et al.
5,827,592 A 10/1998 Van Gulik et al.
5,860,267 A 1/1999 Pervan
5,899,038 A 5/1999 Stroppiana
5,900,099 A 5/1999 Sweet et al.
5,925,211 A 7/1999 Rakauskas
5,935,668 A 8/1999 Smith
5,943,239 A 8/1999 Shamblin et al.
5,968,625 A 10/1999 Hudson
5,987,839 A 11/1999 Hamar et al.
6,006,486 A 12/1999 Moriau et al.
6,023,907 A 2/2000 Pervan
6,029,416 A 2/2000 Andersson
6,094,882 A 8/2000 Pervan
6,101,778 A 8/2000 Martensson
6,119,423 A 9/2000 Costantino
6,134,854 A 10/2000 Stanchfield
6,148,884 A 11/2000 Bolyard et al.
6,173,548 B1 1/2001 Hamar et al.
6,182,410 B1 2/2001 Pervan
6,203,653 B1 3/2001 Seidner
6,205,639 B1 3/2001 Pervan
6,209,278 B1 4/2001 Tychsen
6,216,403 B1 4/2001 Belbeoc'h
6,216,409 B1 4/2001 Roy et al.
6,247,285 B1 6/2001 Moebus
6,314,701 B1 11/2001 Meyerson
6,324,803 B1 12/2001 Pervan
6,332,733 B1 12/2001 Hamberger et al.
6,339,908 B1 1/2002 Chuang
6,345,481 B1 2/2002 Nelson
6,363,677 B1 4/2002 Chen et al.
6,385,936 B1 5/2002 Schneider
6,397,547 B1 6/2002 Martensson
6,421,970 B1 7/2002 Martensson et al.
6,438,919 B1 8/2002 Knauseder
6,446,405 B1 9/2002 Pervan
6,490,836 B1 12/2002 Moriau et al.
6,497,079 B1 12/2002 Pletzer et al.
6,505,452 B1 1/2003 Hannig et al.
6,510,665 B2 1/2003 Pervan
6,516,579 B1 2/2003 Pervan
6,526,719 B2 3/2003 Pletzer et al.
6,532,709 B2 3/2003 Pervan
6,536,178 B1 3/2003 Palsson et al.
6,546,691 B2 4/2003 Leopolder
6,584,747 B2 7/2003 Kettler et al.
6,601,359 B2 8/2003 Olofsson
6,606,834 B2 8/2003 Martensson et al.
6,647,689 B2 11/2003 Pletzer et al.
6,647,690 B1 11/2003 Martensson
6,670,019 B2 12/2003 Andersson
6,672,030 B2 1/2004 Schulte
6,684,592 B2 2/2004 Martin
6,715,253 B2 4/2004 Pervan
6,722,809 B2 4/2004 Hamberger et al.
6,763,643 B1 7/2004 Martensson
6,769,218 B2 8/2004 Pervan
6,769,219 B2 8/2004 Schwitte et al.
6,786,019 B2 9/2004 Thiers
6,823,638 B2 11/2004 Stanchfield
6,851,241 B2 2/2005 Pervan
6,854,235 B2 2/2005 Martensson
6,862,857 B2 3/2005 Tychsen
6,874,292 B2 4/2005 Moriau et al.
6,880,305 B2 4/2005 Pervan
6,898,913 B2 5/2005 Pervan
6,918,220 B2 7/2005 Pervan
6,922,964 B2 8/2005 Pervan
6,933,043 B1 8/2005 Son et al.
7,003,924 B2 2/2006 Kettler et al.
7,003,925 B2 2/2006 Pervan
7,022,189 B2 4/2006 Delle VeDove
7,040,068 B2 5/2006 Moriau et al.
7,051,486 B2 5/2006 Pervan
7,086,205 B2 8/2006 Pervan
7,121,059 B2 10/2006 Pervan
7,137,229 B2 11/2006 Pervan
RE39,439 E 12/2006 Pervan
7,356,971 B2 4/2008 Pervan
7,398,625 B2 7/2008 Pervan
2001/0029720 A1 10/2001 Pervan
2002/0014047 A1 2/2002 Thiers
2002/0020127 A1 2/2002 Thiers et al.
2002/0031646 A1 3/2002 Chen et al.
2002/0046528 A1 4/2002 Pervan et al.
2002/0100231 A1 8/2002 Miller et al.
2002/0178674 A1 12/2002 Pervan
2002/0178682 A1 12/2002 Pervan
2003/0024199 A1 2/2003 Pervan et al.
2003/0033777 A1 2/2003 Thiers et al.
2003/0101674 A1 6/2003 Pervan
2003/0221387 A1 12/2003 Shah
2003/0233809 A1 12/2003 Pervan
2004/0035078 A1 2/2004 Pervan
2004/0035079 A1 2/2004 Evjen
2004/0139678 A1 7/2004 Pervan
2004/0177584 A1 9/2004 Pervan
2004/0206036 A1 10/2004 Pervan
2004/0241374 A1 12/2004 Thiers et al.
2004/0255541 A1 12/2004 Thiers
2005/0034404 A1 2/2005 Pervan
2005/0034405 A1 2/2005 Pervan
2005/0102937 A1 5/2005 Pervan
2005/0108970 A1 5/2005 Liu
2005/0138881 A1 6/2005 Pervan
2005/0160694 A1 7/2005 Pervan
2005/0161468 A1 7/2005 Wagner
2005/0166502 A1 8/2005 Pervan
2005/0166514 A1 8/2005 Pervan
2005/0166516 A1 8/2005 Pervan
2005/0193677 A1 9/2005 Vogel
2005/0208255 A1 9/2005 Pervan
2005/0210810 A1 9/2005 Pervan
2005/0235593 A1 10/2005 Hecht
2006/0048474 A1 3/2006 Pervan
2006/0070333 A1 4/2006 Pervan
2006/0073320 A1 4/2006 Pervan
2006/0075713 A1 4/2006 Pervan
2006/0101769 A1 5/2006 Pervan
2006/0117696 A1 6/2006 Pervan
2006/0179773 A1 8/2006 Pervan
2006/0196139 A1 9/2006 Pervan
2007/0119110 A1 5/2007 Pervan
2007/0159814 A1 7/2007 Jacobsson
2008/0000182 A1 1/2008 Pervan
2008/0000189 A1 1/2008 Pervan
2008/0000190 A1 1/2008 Hakansson et al.

| | | | |
|---|---|---|---|
| 2008/0005992 | A1 | 1/2008 | Pervan |
| 2008/0028707 | A1 | 2/2008 | Pervan |
| 2008/0060308 | A1 | 3/2008 | Pervan |
| 2009/0151291 | A1 | 6/2009 | Pervan |

FOREIGN PATENT DOCUMENTS

| | | | |
|---|---|---|---|
| AU | 713628 | | 1/1998 |
| AU | 200020703 | A1 | 6/2000 |
| BE | 417526 | | 9/1936 |
| BE | 0557844 | | 6/1957 |
| BE | 1010339 | A3 | 6/1998 |
| BE | 1010487 | A6 | 10/1998 |
| CA | 0991373 | | 6/1976 |
| CA | 2226286 | | 12/1997 |
| CA | 2252791 | | 5/1999 |
| CA | 2289309 | | 7/2000 |
| CA | 2 363 184 | | 7/2001 |
| CH | 200949 | | 1/1939 |
| CH | 211877 | | 1/1941 |
| CH | 690 242 | A5 | 6/2000 |
| DE | 1 212 275 | | 3/1966 |
| DE | 7102476 | | 1/1971 |
| DE | 1 534 278 | | 11/1971 |
| DE | 2 159 042 | | 6/1973 |
| DE | 2 205 232 | | 8/1973 |
| DE | 7402354 | | 1/1974 |
| DE | 2 238 660 | | 2/1974 |
| DE | 2 252 643 | | 5/1974 |
| DE | 2 502 992 | | 7/1976 |
| DE | 2 616 077 | | 10/1977 |
| DE | 2 917 025 | | 11/1980 |
| DE | 30 41 781 | A1 | 6/1982 |
| DE | 32 14 207 | A1 | 11/1982 |
| DE | 32 46 376 | C2 | 6/1984 |
| DE | 3343601 | A1 | 6/1985 |
| DE | 35 38 538 | A1 | 10/1985 |
| DE | 8604004 | | 6/1986 |
| DE | 3512204 | A1 | 10/1986 |
| DE | 3544845 | A1 | 6/1987 |
| DE | 3631390 | A1 | 12/1987 |
| DE | 39 18 676 | A1 | 8/1990 |
| DE | 40 02 547 | A1 | 8/1991 |
| DE | 41 30 115 | A1 | 9/1991 |
| DE | 4134452 | A1 | 4/1993 |
| DE | 4215273 | A1 | 11/1993 |
| DE | 4242530 | A1 | 6/1994 |
| DE | 43 13 037 | C1 | 8/1994 |
| DE | 93 17 191 | U1 | 3/1995 |
| DE | 296 10 462 | U1 | 10/1996 |
| DE | 196 01 322 | A1 | 5/1997 |
| DE | 296 18 318 | U1 | 5/1997 |
| DE | 297 10 175 | U1 | 9/1997 |
| DE | 196 51 149 | A1 | 6/1998 |
| DE | 197 09 641 | A1 | 9/1998 |
| DE | 197 18 319 | A1 | 11/1998 |
| DE | 197 18 812 | A1 | 11/1998 |
| DE | 299 22 649 | U1 | 4/2000 |
| DE | 200 01 225 | U1 | 8/2000 |
| DE | 200 02 744 | U1 | 9/2000 |
| DE | 199 25 248 | A1 | 12/2000 |
| DE | 200 13 380 | | 12/2000 |
| DE | 200 17 461 | U1 | 3/2001 |
| DE | 200 18 284 | U1 | 3/2001 |
| DE | 100 01 248 | A1 | 7/2001 |
| DE | 100 32 204 | C1 | 7/2001 |
| DE | 100 44 016 | C2 | 3/2002 |
| DE | 202 05 774 | U1 | 8/2002 |
| DE | 203 07 580 | U1 | 7/2003 |
| DE | 203 17 527 | U1 | 1/2004 |
| DE | 20 2004 001 038 | U1 | 5/2004 |
| DE | 20 2005 006 300 | U1 | 8/2005 |
| DE | 10 2004 054 368 | A1 | 5/2006 |
| EP | 0 248 127 | A1 | 12/1987 |
| EP | 0 487 925 | A1 | 6/1992 |
| EP | 0 623 724 | A1 | 11/1994 |
| EP | 0 652 340 | A1 | 5/1995 |
| EP | 0 665 347 | A1 | 8/1995 |
| EP | 0 690 185 | A1 | 1/1996 |
| EP | 0 698 162 | B1 | 2/1996 |
| EP | 0 843 763 | B1 | 5/1998 |
| EP | 0 849 416 | A2 | 6/1998 |
| EP | 0 855 482 | B1 | 7/1998 |
| EP | 0 877 130 | B1 | 11/1998 |
| EP | 0 661 135 | B1 | 12/1998 |
| EP | 0 903 451 | A2 | 3/1999 |
| EP | 0 958 441 | | 11/1999 |
| EP | 0 969 163 | A2 | 1/2000 |
| EP | 0 969 163 | A3 | 1/2000 |
| EP | 0 969 164 | A2 | 1/2000 |
| EP | 0 969 164 | A3 | 1/2000 |
| EP | 0 974 713 | A1 | 1/2000 |
| EP | 0 976 889 | A1 | 2/2000 |
| EP | 1 045 083 | B1 | 10/2000 |
| EP | 1 048 423 | A2 | 11/2000 |
| EP | 1 120 515 | A1 | 8/2001 |
| EP | 1 146 182 | A2 | 10/2001 |
| EP | 1 165 906 | | 1/2002 |
| EP | 1 215 352 | A2 | 6/2002 |
| EP | 1 223 265 | A2 | 7/2002 |
| EP | 1 251 219 | A1 | 10/2002 |
| EP | 1 262 609 | A1 | 12/2002 |
| EP | 1 317 983 | A2 | 6/2003 |
| EP | 1 338 344 | A2 | 8/2003 |
| EP | 1 437 457 | A2 | 7/2004 |
| FI | 843060 | | 8/1984 |
| FR | 1 293 043 | | 4/1962 |
| FR | 2 568 295 | | 1/1986 |
| FR | 2 630 149 | | 10/1989 |
| FR | 2 637 932 | A1 | 4/1990 |
| FR | 2 675 174 | | 10/1992 |
| FR | 2 691 491 | | 11/1993 |
| FR | 2 697 275 | | 4/1994 |
| FR | 2 712 329 | A1 | 5/1995 |
| FR | 2 781 513 | A1 | 1/2000 |
| FR | 2 785 633 | A1 | 5/2000 |
| FR | 2 810 060 | A1 | 12/2001 |
| FR | 2 846 023 | | 4/2004 |
| GB | 240629 | | 10/1925 |
| GB | 424057 | | 2/1935 |
| GB | 585205 | | 1/1947 |
| GB | 599793 | | 3/1948 |
| GB | 636423 | | 4/1950 |
| GB | 812671 | | 4/1959 |
| GB | 1127915 | | 9/1968 |
| GB | 1171337 | | 11/1969 |
| GB | 1237744 | | 6/1971 |
| GB | 1275511 | | 5/1972 |
| GB | 1 394 621 | | 5/1975 |
| GB | 1430423 | | 3/1976 |
| GB | 2117813 | A | 10/1983 |
| GB | 2126106 | A | 3/1984 |
| GB | 2243381 | A | 10/1991 |
| GB | 2256023 | A * | 11/1992 |
| JP | 54-65528 | | 5/1979 |
| JP | 57-119056 | | 7/1982 |
| JP | 57-185110 | | 11/1982 |
| JP | 59-186336 | | 11/1984 |
| JP | 1-178659 | A | 7/1989 |
| JP | 3-169967 | | 7/1991 |
| JP | 4-106264 | | 4/1992 |
| JP | 4-191001 | | 7/1992 |
| JP | 5-148984 | | 6/1993 |
| JP | 6-146553 | A | 5/1994 |
| JP | 6-056310 | | 8/1994 |
| JP | 6-320510 | A | 11/1994 |

| | | | |
|---|---|---|---|
| JP | 7-076923 | A | 3/1995 |
| JP | 7-180333 | A | 7/1995 |
| JP | 7-300979 | A | 11/1995 |
| JP | 7-310426 | A | 11/1995 |
| JP | 8-109734 | | 4/1996 |
| JP | 9-38906 | | 2/1997 |
| JP | 9-88315 | | 3/1997 |
| JP | 2000-179137 | | 6/2000 |
| JP | P2000-226932 | | 8/2000 |
| JP | 2001-173213 | | 6/2001 |
| JP | 2001-179710 | | 7/2001 |
| JP | 2001-254503 | | 9/2001 |
| JP | 2001-260107 | | 9/2001 |
| JP | P2001-329681 | | 11/2001 |
| JP | 2003-200405 | A | 7/2003 |
| NL | 7601773 | | 8/1976 |
| NO | 157871 | | 7/1984 |
| NO | 305614 | | 5/1995 |
| PL | 24931 | U | 11/1974 |
| SE | 372 051 | | 5/1973 |
| SE | 450 141 | | 6/1984 |
| SE | 501 014 | C2 | 10/1994 |
| SE | 502 994 | | 3/1996 |
| SE | 506 254 | C2 | 11/1997 |
| SE | 509 059 | | 6/1998 |
| SE | 509 060 | | 6/1998 |
| SE | 512 290 | | 12/1999 |
| SE | 512 313 | | 12/1999 |
| SE | 0000200-6 | | 7/2001 |
| SU | 363795 | | 11/1973 |
| SU | 1680359 | A1 | 9/1991 |
| WO | 84/02155 | | 6/1984 |
| WO | 87/03839 | A1 | 7/1987 |
| WO | 92/17657 | | 10/1992 |
| WO | 93/13280 | | 7/1993 |
| WO | 94/01628 | | 1/1994 |
| WO | 94/26999 | | 11/1994 |
| WO | 96/27719 | | 9/1996 |
| WO | 96/27721 | | 9/1996 |
| WO | 96/30177 | A1 | 10/1996 |
| WO | 97/19232 | A1 | 5/1997 |
| WO | 97/47834 | | 12/1997 |
| WO | 98/22677 | A1 | 5/1998 |
| WO | 98/24994 | | 6/1998 |
| WO | 98/24995 | | 6/1998 |
| WO | 98/38401 | A1 | 9/1998 |
| WO | 99/40273 | A1 | 8/1999 |
| WO | 99/66151 | | 12/1999 |
| WO | 99/66152 | | 12/1999 |
| WO | 00/06854 | | 1/2000 |
| WO | 00/20705 | A1 | 4/2000 |
| WO | 00/20706 | A1 | 4/2000 |
| WO | 00/66856 | A1 | 11/2000 |
| WO | 01/02669 | A1 | 1/2001 |
| WO | 01/07729 | A1 | 2/2001 |
| WO | 01/51733 | A1 | 7/2001 |
| WO | 01/66876 | A1 | 9/2001 |
| WO | 01/66877 | A1 | 9/2001 |
| WO | 01/75247 | A1 | 10/2001 |
| WO | 01/77461 | A1 | 10/2001 |
| WO | 01/96688 | A1 | 12/2001 |
| WO | 01/98603 | A2 | 12/2001 |
| WO | 01/98604 | A1 | 12/2001 |
| WO | 02/055809 | A1 | 7/2002 |
| WO | 02/055810 | A1 | 7/2002 |
| WO | 02/060691 | A1 | 8/2002 |
| WO | 03/016654 | A1 | 2/2003 |
| WO | 03/070384 | | 8/2003 |
| WO | 03/074814 | A1 | 9/2003 |
| WO | 03/078761 | A1 | 9/2003 |
| WO | 03/083234 | A1 | 10/2003 |
| WO | 03/099461 | | 12/2003 |
| WO | 2004/083557 | A1 | 9/2004 |
| WO | 2005/077625 | | 8/2005 |
| WO | 2005/110677 | | 11/2005 |
| WO | 2006/008578 | | 1/2006 |
| WO | 2006/111437 | | 10/2006 |
| WO | 2006/113757 | | 10/2006 |

OTHER PUBLICATIONS

Opposition EP 0.698,162 B1—Facts-Grounds-Arguments, dated Apr. 1, 1999, pp. 1-56.

Opposition II EP 0.698,162 B1—Facts-Grounds-Arguments, dated Apr. 30, 1999, (17 pages)—with translation (11 pages).

Opposition I: Unilin Decor N.V./Välinge Aluminum AB, communication dated Jun. 8, 1999 to European Patent Office, pp. 1-2.

Opposition I: Unilin Decor N.V./Välinge Aluminum AB, communication dated Jun. 16, 1999 to European Patent Office, pp. 1-2.

FI Office Action dated Mar. 19, 1998.

NO Office Action dated Dec. 22, 1997.

NO Office Action dated Sep. 21, 1998.

Opposition EP 0.877.130 B1—Facts—Arguments, dated Jun. 28, 2000, pp. 1-13.

RU Application Examiner Letter dated Sep. 26, 1997.

NZ Application Examiner Letter dated Oct. 21, 1999.

European prosecution file history to grant, European Patent No. 94915725.9-2303/0698162, grant date Sep. 16, 1998.

European prosection file history to grant, European Patent No. 98106535.2-2303/0855482, grant date Dec. 1, 1999.

European prosecution file history to grant, European Patent No. 98201555.4-2303/0877130, grant date Jan. 26, 2000.

Communication of Notices of Intervention by E.F.P. Floor Products dated Mar. 17, 2000, in European Patent Application 0698162, pp. 1-11 with annex pp. 1-21.

Response to the E.F.P. Floor Products intervention dated Jun. 28, 2000, pp. 1-5.

Letters from the Opponent dated Jul. 26, 2001 and Jul. 30, 2001 including Annexes 1 to 3.

Communication from European Patent Office dated Sep. 20, 2001 in European Patent No. 0698162, pp. 1-2 with Facts and Submissions Annex pp. 1-18, Minutes Annex pp. 1-11, and Annex I to VI.

Communication from Swedish Patent Office dated Sep. 21, 2001, in Swedish Patent No. 9801986-2, pp. 1-3 in Swedish with forwarding letter dated Sep. 24, 2001, in English.

*Pergo, Inc.* v. *Välinge Aluminium AB, Berry Finance NV, and Alloc, Inc.*; U.S. District Court for the District of Columbia; Civil Action No. 1:00CV01618.

*Alloc, Inc.* v. *Unilin Decor NV and BHK of America, Inc.*; U.S. District Court for the Eastern District of Wisconsin; Civil Action No. 00-C-0999.

*Unilin Beheer B.V., Unilin Decor, N.V., and BHK of America, Inc.* v. *Välinge Aluminium AB*; U.S. District Court for the District of Columbia; Civil Action No. 1:00CV01823.

*Alloc, Inc., Berry Finance NV, and Välinge Aluminium AB* v. *Unilin Decor NV, BHK of America, Inc., Pergo, Inc., Meister-Leisten Schulte GmbH, Akzenta Paneele+Profile GmbH, Tarkett, Inc., and Roysol*; ITC No. 337-TA-443 Filed Dec. 4, 2000.

*Alloc, Inc., Berry Finance NV, and Välinge Aluminium AB* v. *Tarkett, Inc.*; U.S. District Court for the Eastern District of Wisconsin; Civil Action No. 00-CV-1377.

Välinge, Fibo-Trespo Brochure, Distributed at the Domotex Fair in Hanover, Germany, Jan. 1996.

Träindustrins Handbook "Snickeriarbete", 2nd Edition, Malmö 1952, pp. 826, 827, 854, and 855, published by Teknografiska Aktiebolaget, Sweden.

"Träbearbetning", Anders Grönlund, 1986, ISBN 91-970513-2-2, pp. 357-360, published by Institutet for Trateknisk Forskning, Stockholm, Sweden.

Drawing Figures 25/6107 from Buetec GmbH dated Dec. 16, 1985.

Pamphlet from Serexhe for Compact-Praxis, entitled "Selbst Teppichböden, PVC und Parkett verlegen", Published by Compact Verlag, München, Germany 1985, pp. 84-87.

Pamphlet from Junckers Industrser A/S entitled "Bøjlesystemet til Junckers boliggulve" Oct. 1994, Published by Junckers Industrser A/S, Denmark.

Pamphlet from Junckers Industrser A/S entitled "The Clip System for Junckers Sports Floors", Annex 7, 1994, Published by Junckers Industrser A/S, Denmark.
Pamphlet from Junckers Industrser A/S entitled "The Clip System for Junckers Domestic Floors", Annex 8, 1994, Published by Junckers Industrser A/S, Denmark.
Fibo-Trespo Alloc System Brochure entitled "Opplæring OG Autorisasjon", pp. 1-29, Fibo-Trespo.
"Revolution bei der Laminatboden-Verl", boden wand decke, vol. No. 11 of 14, Jan. 10, 1997, p. 166.
Kährs Focus Extra dated Jan. 2001, pp. 1-9.
Brochure for CLIC Laminate Flooring, Art.-Nr. 110 11 640.
Brochure for Laminat-Boden "Clever-Click", Parador® Wohnsysteme.
Brochure for PERGO®, CLIC Laminate Flooring, and Prime Laminate Flooring from Bauhaus, The Home Store, Malmö, Sweden.
Darko Pervan, U.S. Appl. No. 09/714,514 entitled "Locking System and Flooring Board" filed Nov. 17, 2000.
U.S. Court of Appeals for the Federal Circuit, 02-1222-1291, *ALLOC, Inc.* v. *International Trade Commission*, pp. 1-32.
Darko Pervan, U.S. Appl. No. 11/092,748 entitled "Mechanical Locking System for Panels and Method of Installing Same" filed Mar. 30, 2005.
Darko Pervan, U.S. Appl. No. 10/908,658 entitled "Mechanical Locking System for Floor Panels" filed May 20, 2005.
Jacobsson, Jan, et al., U.S. Appl. No. 11/521,439, entitled "Device and Method for Compressing an Edge of a Building Panel and a Building Panel With Compressed Edges", filed Sep. 15, 2006.
Pervan, Darko, U.S. Appl. No. 11/627,971, entitled "Locking System for Floorboards", filed Jan. 28, 2007.
Status of Cases—District Court and Administrative (as of May 11, 2007).
*Alloc, Inc.* v. *International Trade Commission*, 342 F.3d 1361 (Fed. Cir. 2003).
*Alloc, Inc., Berry Finance, N.V. and Valinge Aluminium AB* v. *Norman D. Lifton Co., Inc., Balta U.S. Inc. and Balterio, N.V.*, United States District Court Southern District of New York, Case No. 03-Civ.-4419 (KMW) (DF), *Defendants' Amended Answer*.
*In the Matter of Certain Flooring Products*, United States International Trade Commission, Washington, D.C., Inv. No. 337-TA-443, *Final Initial Determination*.
*Alloc, Inc., Berry Finance N.V. and Valinge Innovation AB* v. *Kronotex USA, Inc.*, United States District Court for the Northern District of Illinois, No. 04C 8203, *Answer and Counterclaims*.
*Alloc, Inc., Berry Finance N.V. and Valinge Innovation AB* (*f.k.a. Valinge Aluminium AB*) v. *Unilin Décor, N.V. and BHK of America, Inc. and PERGO, Inc.*, United States District Court for the Eastern District of Wisconsin, Case No. 00-C-0999, *Pergo, Inc.'s Answer to Plaintiffs' Second Amended Complaint for Patent Infringement*.
*Alloc, Inc., Berry Finance N.V. and Valinge Innovation AB* v. *Unilin Décor, N.V. and Quick-Step Flooring, Inc.*, United States District Court for the District of Delaware, C.A. No. 03-253 (GMS), *Answer and Counterclaim of Defendants Unilin Décor, N.V. and Quick-Step Flooring, Inc*.
*Valinge Innovation AB, Alloc, Inc., et al* v. *Norman D. Lifton Co., et al*, United States District Court Southern District of New York,Case No. 03 Civ. 4419 (PAC), *Opinion and Order on Claim Construction*.
*Alloc, Inc., Berry Finance, N.V. and Valinge Aluminium AB* v. *Norman D. Lifton Co., Inc., Balta U.S. Inc. and Balterio, N.V.*, United States District Court Southern District of New York, Case No. 03-Civ.-4419 (KMW) (DF), *Defendants' Amended Answer*.
Pervan, Darko, et al., U.S. Appl. No. 11/635,674, entitled "Laminate Floor Panels," filed Dec. 8, 2006.
Pervan, Darko, et al., U.S. Appl. No. 11/635,633, entitled "Laminate Floor Panels," filed Dec. 8, 2006.
Hakansson, Niclas, U.S. Appl. No. 11/643,881, entitled "V-GROOVE," filed Dec. 22, 2006.
Bergelin, Marcus, et al., U.S. Appl. No. 11/649,837, entitled "Resilient Groove," filed Jan. 5, 2007.
Pervan, Darko, et al., U.S. Appl. No. 11/575,600, entitled "Mechanical Locking of Floor Panels with a Flexible Tongue," filed Mar. 20, 2007.
Pervan, Darko, U.S. Appl. No. 11/806,478, entitled "Wear Resistant Surface," filed May 31, 2007.
Pervan, Darko, et al., U.S. Appl. No. 11/770,771, entitled "Locking System Comprising a Combination Lock for Panels," filed Jun. 29, 2007.
Pervan, Darko, et al., U.S. Appl. No. 11/775,885, entitled "Mechanical Locking of Floor Panels with a Flexible Bristle Tongue," filed Jul. 11, 2007.
Pervan, Darko, U.S. Appl. No. 11/839,259, entitled "Locking System and Flooring Board," filed Aug. 15, 2007.
Correspondence from Bütec cited during opposition procedure at EPO in DE Patent No. 3343601, including announcement of Oct. 1984 re "Das Festprogram von Bütec: Mehrzweckbühnen, tanzplatten, Schonbeläge, Tanzbeläge, Bestuhlung"; letter of Nov. 7, 2001 to Perstorp Support AB with attached brochure published Oct. 1984 and installation instructions published Nov. 1984; and letter of Nov. 19, 2001 to Perstorp Support AB.
Pervan, U.S. Appl. No. 12/785,784, entitled "Locking System for Floorboards," filed in the U. S. Patent and Trademark Office on May 24, 2010.
Pervan, U.S. Appl. No. 12/834,258, entitled "Locking System for Mechanical Joining of Floorboards and Method for Production Thereof," filed in the U. S. Patent and Trademark Office on Jul. 12, 2010.

* cited by examiner

FLOOR PANEL WITH A TONGUE, GROOVE AND A STRIP

CROSS-REFERENCE TO RELATED APPLICATIONS

The present application is a continuation of U.S. Ser. No. 10/202,093, which was filed on Jul. 25, 2002, and which is a continuation of Ser. No. 09/534,007, which was filed on Mar. 24, 2000, now U.S. Pat. No. 6,516,579, which was a continuation of Ser. No. 09/356,563, which was filed on Jul. 19, 1999, now U.S. Pat. No. 6,182,410, and which is a continuation of Ser. No. 09/193,687, which was filed on Nov. 18, 1998, now U.S. Pat. No. 6,023,907, which was a continuation of Ser. No. 09/003,499 which was filed on Jan. 6, 1998, now U.S. Pat. No. 5,860,267, and which is a continuation of Ser. No. 08/436,224, which was filed on May 17, 1995, now U.S. Pat. No. 5,706,621, which was a national stage entry of PCT/SE94/00386, filed in Sweden on Apr. 29, 1994. The entire contents of the aforementioned patents and patent applications are incorporated herein by reference.

TECHNICAL FIELD

The invention generally relates to a system for providing a joint along adjacent joint edges of two building panels, especially floor panels.

More specifically, the joint is of the type where the adjacent joint edges together form a first mechanical connection locking the joint edges to each other in a first direction at right angles to the principal plane of the panels, and where a locking device forms a second mechanical connection locking the panels to each other in a second direction parallel to the principal plane and at right angles to the joint edges, the locking device comprising a locking groove which extends parallel to and spaced from the joint edge of one of the panels, and said locking groove being open at the rear side of this one panel.

The invention is especially well suited for use in joining floor panels, especially thin laminated floors. Thus, the following description of the prior art and of the objects and features of the invention will be focused on-this field of use. It should however be emphasized that the invention is useful also for joining ordinary wooden floors as well as other types of building panels, such as wall panels and roof slabs.

BACKGROUND OF THE INVENTION

A joint of the aforementioned type is known e.g. from SE 450,141. The first mechanical connection is achieved by means of joint edges having tongues and grooves. The locking device for the second mechanical connection comprises two oblique locking grooves, one in the rear side of each panel, and a plurality of spaced-apart spring clips which are distributed along the joint and the legs of which are pressed into the grooves, and which are biased so as to tightly clamp the floor panels together. Such a joining technique is especially useful for joining thick floor panels to form surfaces of a considerable expanse.

Thin floor panels of a thickness of about 7-10 mm, especially laminated floors, have in a short time taken a substantial share of the market. All thin floor panels employed are laid as "floating floors" without being attached to the supporting structure. As a rule, the dimension of the floor panels is 200×1200 mm, and their long and short sides are formed with tongues and grooves. Traditionally, the floor is assembled by applying glue in the groove and forcing the floor panels together. The tongue is then glued in the groove of the other panel. As a rule, a laminated floor consists of an upper decorative wear layer of laminate having a thickness of about 1 mm, an intermediate core of particle board or other board, and a base layer to balance the construction. The core has essentially poorer properties than the laminate, e.g., in respect of hardness and water resistance, but it is nonetheless needed primarily for providing a groove and tongue for assemblage. This means that the overall thickness must be at least about 7 mm. These known laminated floors using glued tongue-and-groove joints however suffer from several inconveniences.

First, the requirement of an overall thickness of at least about 7 mm entails an undesirable restraint in connection with the laying of the floor, since it is easier to cope with low thresholds when using thin floor panels, and doors must often be adjusted in height to come clear of the floor laid. Moreover, manufacturing costs are directly linked with the consumption of material.

Second, the core must be made of moisture-absorbent material to permit using water-based glues when laying the floor. Therefore, it is not possible to make the floors thinner using so-called compact laminate, because of the absence of suitable gluing methods for such non-moisture-absorbent core materials.

Third, since the laminate layer of the laminated floors is highly wear-resistant, tool wear is a major problem when working the surface in connection with the formation of the tongue.

Fourth, the strength of the joint, based on a glued tongue-and-groove connection, is restricted by the properties of the core and of the glue as well as by the depth and height of the groove. The laying quality is entirely dependent on the gluing. In the event of poor gluing, the joint will open as a result of the tensile stresses which occur e.g. in connection with a change in air humidity.

Fifth, laying a floor with glued tongue-and-groove joints is time-consuming, in that glue must be applied to every panel on both the long and short sides thereof.

Sixth, it is not possible to disassemble a glued floor once laid, without having to break up the joints. Floor panels that have been taken up cannot therefore be used again. This is a drawback particularly in rental houses where the flat concerned must be put back into the initial state of occupancy. Nor can damaged or worn-out panels be replaced without extensive efforts, which would be particularly desirable on public premises and other areas where parts of the floor are subjected to great wear.

Seventh, known laminated floors are not suited for such use as involves a considerable risk of moisture penetrating down into the moisture-sensitive core.

Eighth, present-day hard, floating floors require, prior to laying the floor panels on hard subfloors, the laying of a separate underlay of floor board, felt, foam or the like, which is to damp impact sounds and to make the floor more pleasant to walk on. The placement of the underlay is a complicated operation, since the underlay must be placed in edge-to-edge fashion. Different under-lays affect the properties of the floor.

There is thus a strongly-felt need to overcome the above-mentioned drawbacks of the prior art. It is however not possible simply to use the known joining technique with glued tongues and grooves for very thin floors, e.g. with floor thicknesses of about 3 mm, since a joint based on a tongue-and-groove connection would not be sufficiently strong and practically impossible to produce for such thin floors. Nor are any other known joining techniques usable for such thin floors. Another reason why the making of thin floors from, e.g., compact laminate involves problems is the thickness tolerances of the panels, being about 0.2-0.3 mm for a panel thickness of about 3 mm. A 3-mm compact laminate panel having such a thickness tolerance would have, if ground to uniform thickness on its rear side, an unsymmetrical design, entailing the risk of bulging. Moreover, if the panels have different thicknesses, this also means that the joint will be subjected to excessive load.

Nor is it possible to overcome the above-mentioned problems by using double-adhesive tape or the like on the undersides of the panels, since such a connection catches directly and does not allow for subsequent adjustment of the panels as is the case with ordinary gluing.

Using U-shaped clips of the type disclosed in the above-mentioned SE 450,141, or similar techniques, to overcome the drawbacks discussed above is no viable alternative either. Especially, biased clips of this type cannot be used for joining panels of such a small thickness as 3 mm. Normally, it is not possible to disassemble the floor panels without having access to their undersides. This known technology relying on clips suffers from the additional drawbacks:

Subsequent adjustment of the panels in their longitudinal direction is a complicated operation in connection with laying, since the clips urge the panels tightly against each other.

Floor laying using clips is time-consuming.

This technique is usable only in those cases where the floor panels are resting on underlying joists with the clips placed therebetween. For thin floors to be laid on a continuous, flat supporting structure, such clips cannot be used.

The floor panels can be joined together only at their long sides. No clip connection is provided on the short sides.

TECHNICAL PROBLEMS AND OBJECTS OF THE INVENTION

A main object of the invention therefore is to provide a system for joining together building panels, especially floor panels for hard, floating floors, which allows using floor panels of a smaller overall thickness than present-day floor panels.

A particular object of the invention is to provide a panel-joining system which:

- makes it possible in a simple, cheap and rational way to provide a joint between floor panels without requiring the use of glue, especially a joint based primarily only on mechanical connections between the panels;
- can be used for joining floor panels which have a smaller thickness than present-day laminated floors and which have, because of the use of a different core material, superior properties than present-day floors even at a thickness of 3 mm;
- makes it possible between thin floor panels to provide a joint that eliminates any unevennesses in the joint because of thickness tolerances of the panels;
- allows joining all the edges of the panels;
- reduces tool wear when manufacturing floor panels with hard surface layers;
- allows repeated disassembly and reassembly of a floor previously laid, without causing damage to the panels, while ensuring high laying quality;
- makes it possible to provide moisture-proof floors;
- makes it possible to obviate the need of accurate, separate placement of an underlay before laying the floor panels; and
- considerably cuts the time for joining the panels.

These and other objects of the invention are achieved by means of a panel-joining system having the features recited in the appended claims.

Thus, the invention provides for floorboards with substantially planar and parallel upper top sides and lower undersides and panel material located between the upper and lower top sides, and a mechanical locking system for locking a first edge of a first floor board to a second edge of a substantially identical second floor board. The mechanical locking system comprising:

- a tongue on the first edge;
- a groove on the second edge;
- the tongue and groove forming a first mechanical connection locking the first and second edges to each other in a first direction at right angles to a principal plane of the floor boards, the tongue and groove being formed in the panel material which is located between said upper top sides and lower side;
- and a locking device arranged on an underside of the first and the second edges, the locking device forming a second mechanical connection locking the first and the second edges to each other in a second direction parallel to the principal plane and at right angles to the edges;
- the locking device includes a locking groove which extends parallel to and spaced from the first edge, the locking groove being formed in the first edge of the panel and being open at an underside of the first edge and including an internal surface;
- the locking device further includes a strip extending distally beyond an upper part of the second edge, the strip extending throughout substantially an entire length of the second edge and being provided with a locking element projecting from the strip;
- wherein the strip, the locking element, and the locking groove are configured such that when the first edge is pressed against an upper part of the second edge and is then angled down, the locking element can enter the locking groove;
- the locking element has a locking surface which faces the second edge and is configured so as to contact the internal surface of the locking groove to prevent substantial separation of the first and second edges when joined together; and
- wherein, when the first edge and the second edge are locked together, there is space in the locking system between the first and the second edges.

Thus, another embodiment of the invention provides a system for making a joint along adjacent joint edges of two building panels, especially floor panels, in which joint:

- the adjacent joint edges together form a first mechanical connection locking the joint edges to each other in a first direction at right angles to the principal plane of the panels, and
- a locking device arranged on the rear side of the panels forms a second mechanical connection locking the panels to each other in a second direction parallel to the principal plane and at right angles to the joint edges, said locking device comprising a locking groove which extends parallel to and spaced from the joint edge of one of said panels, termed groove panel, and which is open at the rear side of the groove panel, said system being characterized in
- that the locking device further comprises a strip integrated with the other of said panels, termed strip panel, said strip extending throughout substantially the entire length of the joint edge of the strip panel and being provided with a locking element projecting from the strip, such that when the panels are joined together, the strip projects on the rear side of the groove panel with its locking element received in the locking groove of the groove panel, that the panels, when joined together, can occupy a relative position in said second direction where a play exists between the locking groove and a locking surface on the locking element that is facing the joint edges and is operative in said second mechanical connection, that the first and the second mechanical connection both allow mutual displacement of the panels in the direction of the joint edges, and that the second mechanical connection is so conceived as to allow the locking element to leave the locking groove if the groove panel is turned about its joint edge angularly away from the strip.

The term "rear side" as used above should be considered to comprise any side of the panel located behind/underneath the front side of the panel. The opening plane of the locking groove of the groove panel can thus be located at a distance from the rear surface of the panel resting on the supporting structure. Moreover, the strip, which in the embodiments of the invention, extends throughout substantially the entire length of the joint edge of the strip panel, should be considered to encompass both the case where the strip is a continuous, uninterrupted element, and the case where the "strip" consists in its longitudinal direction of several parts, together covering the main portion of the joint edge.

It should also be noted (i) that it is the first and the second mechanical connection as such that permit mutual displacement of the panels in the direction of the joint edges, and that (ii) it is the second mechanical connection as such that permits the locking element to leave the locking groove if the groove panel is turned about its joint edge angularly away from the strip. Within the scope of the invention, there may thus exist means, such as glue and mechanical devices, that can counteract or prevent such displacement and/or upward angling.

The system according to an embodiment of the invention makes it possible to provide concealed, precise locking of both the short and long sides of the panels in hard, thin floors. The floor panels can be quickly and conveniently disassembled in the reverse order of laying without any risk of damage to the panels, ensuring at the same time a high laying quality. The panels can be assembled and disassembled much faster than in present-day systems, and any damaged or worn-out panels can be replaced by taking up and re-laying parts of the floor.

According to an especially preferred embodiment of the invention, a system is provided which permits precise joining of thin floor panels having, for example, a thickness of the order of 3 mm and which at the same time provides a tolerance-independent smooth top face at the joint. To this end, the strip is mounted in an equalizing groove which is countersunk in the rear side of the strip panel and which exhibits an exact, predetermined distance from its bottom to the front side of the strip panel. The part of the strip projecting behind the groove panel engages a corresponding equalizing groove, which is countersunk in the rear side of the groove panel and which exhibits the same exact, predetermined distance from its bottom to the front side of the groove panel. The thickness of the strip then is at least so great that the rear side of the strip is flush with, and preferably projects slightly below the rear side of the panels. In this embodiment, the panels will always rest, in the joint, with their equalizing grooves on a strip. This levels out the tolerance and imparts the necessary strength to the joint. The strip transmits horizontal and upwardly-directed forces to the panels and downwardly-directed forces to the existing subfloor.

Preferably, the strip may consist of a material which is flexible, resilient and strong, and can be sawn. A preferred strip material is sheet aluminum. In an aluminum strip, sufficient strength can be achieved with a strip thickness of the order of 0.5 mm.

In order to permit taking up previously laid, joined floor panels in a simple way, a preferred embodiment of the invention is characterized in that when the groove panel is pressed against the strip panel in the second direction and is turned angularly away from the strip, the maximum distance between the axis of rotation of the groove panel and the locking surface of the locking groove closest to the joint edges is such that the locking element can leave the locking groove without contacting the locking surface of the locking groove. Such a disassembly can be achieved even if the aforementioned play between the locking groove and the locking surface is not greater than 0.2 mm.

According to the invention, the locking surface of the locking element is able to provide a sufficient locking function even with very small heights of the locking surface. Efficient locking of 3-mm floor panels can be achieved with a locking surface that is as low as 2 mm. Even a 0.5-mm-high locking surface may provide sufficient locking. The term "locking surface" as used herein relates to the part of the locking element engaging the locking groove to form the second mechanical connection.

For optimal function of the invention, the strip and the locking element should be formed on the strip panel with high precision. Especially, the locking surface of the locking element should be located at an exact distance from the joint edge of the strip panel. Furthermore, the extent of the engagement in the floor panels should be minimized, since it reduces the floor strength.

By known manufacturing methods, it is possible to produce a strip with a locking pin, for example by extruding aluminum or plastics into a suitable section, which is thereafter glued to the floor panel or is inserted in special grooves. These and all other traditional methods do however not ensure optimum function and an optimum level of economy. To produce the joint system according to an embodiment of the invention, the strip is suitably formed from sheet aluminum, and is mechanically fixed to the strip panel.

The laying of the panels can be performed by first placing the strip panel on the subfloor and then moving the groove panel with its long side up to the long side of the strip panel, at an angle between the principal plane of the groove panel and the subfloor. When the joint edges have been brought into engagement with each other to form the first mechanical connection, the groove panel is angled down so as to accommodate the locking element in the locking groove.

Laying can also be performed by first placing both the strip panel and the groove panel flat on the subfloor and then joining the panels parallel to their principal planes while bending the strip downwards until the locking element snaps up into the locking groove. This laying technique enables in particular mechanical locking of both the short and long sides of the floor panels. For example, the long sides can be joined together by using the first laying technique with downward angling of the groove panel, while the short sides are subsequently joined together by displacing the groove panel in its longitudinal direction until its short side is pressed on and locked to the short side of an adjacent panel in the same row.

In connection with their manufacture, the floor panels can be provided with an underlay of e.g. floor board, foam or felt. The underlay should preferably cover the strip such that the joint between the underlays is offset in relation to the joint between the floor panels.

The above and other features and advantages of the invention will appear from the appended claims and the following description of embodiments of the invention.

The embodiments of the invention will now be described in more detail hereinbelow with reference to the accompanying drawing Figures.

DESCRIPTION OF DRAWING FIGURES

FIGS. 1*a* and 1*b* schematically show in two stages how two floor panels of different thickness are joined together in floating fashion according to a first embodiment of the invention.

FIGS. 2*a-c* show in three stages a method for mechanically joining two floor panels according to a second embodiment of the invention.

FIGS. 3*a-c* show in three stages another method for mechanically joining the floor panels of FIGS. 2*a-c*.

FIGS. 4*a* and 4*b* show a floor panel according to FIGS. 2*a-c* as seen from below and from above, respectively.

DESCRIPTION OF PREFERRED EMBODIMENTS

Figure 1A:
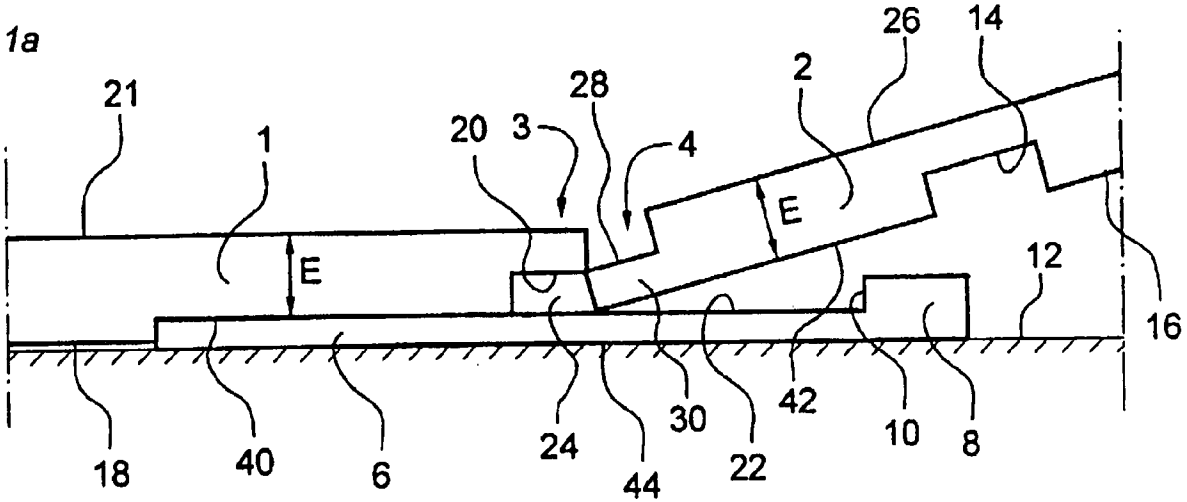
Figure 1B:
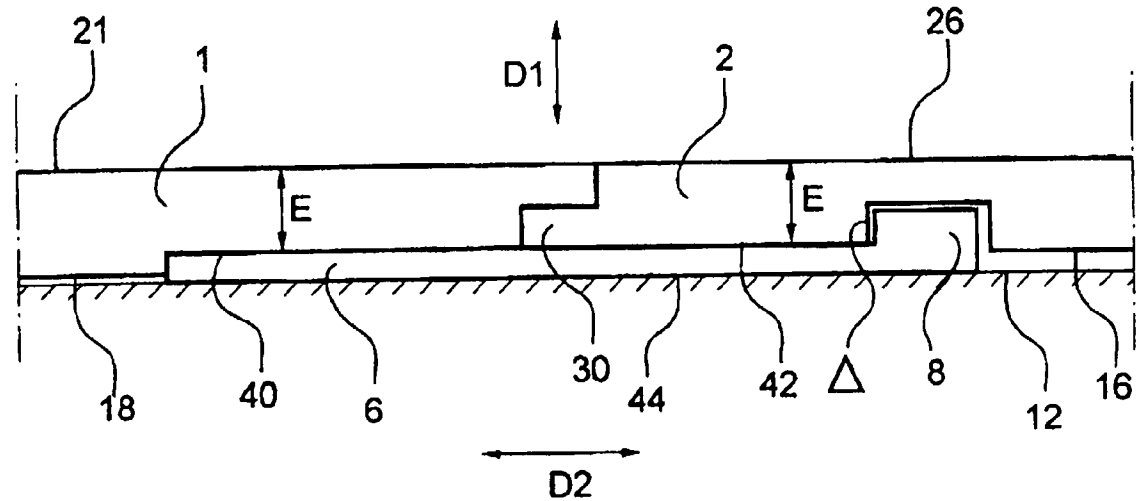

FIGS. 1*a* and 1*b*, to which reference is now made, illustrate a first floor panel 1, hereinafter termed strip panel, and a second floor panel 2, hereinafter termed groove panel. The terms "strip panel" and "groove panel" are merely intended to facilitate the description of the invention, the panels 1, 2 normally being identical in practice. The panels 1 and 2 may be made from compact laminate and may have a thickness of about 3 mm with a thickness tolerance of about +/−0.2 mm. Considering this thickness tolerance, the panels 1, 2 are illustrated with different thicknesses (FIG. 1*b*), the strip panel 1 having a maximum thickness (3.2 mm) and the groove panel 2 having a minimum thickness (2.8 mm).

To enable mechanical joining of the panels 1, 2 at opposing joint edges, generally designated 3 and 4, respectively, the panels are provided with grooves and strips as described in the following.

Figure 4A:
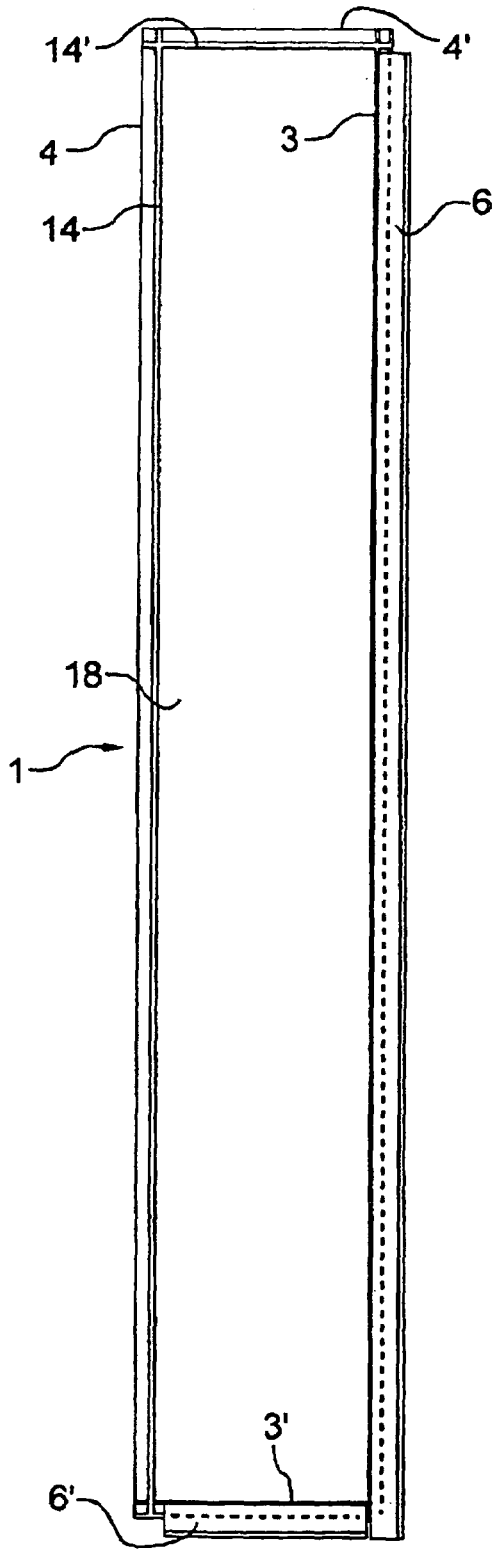
Figure 4B:
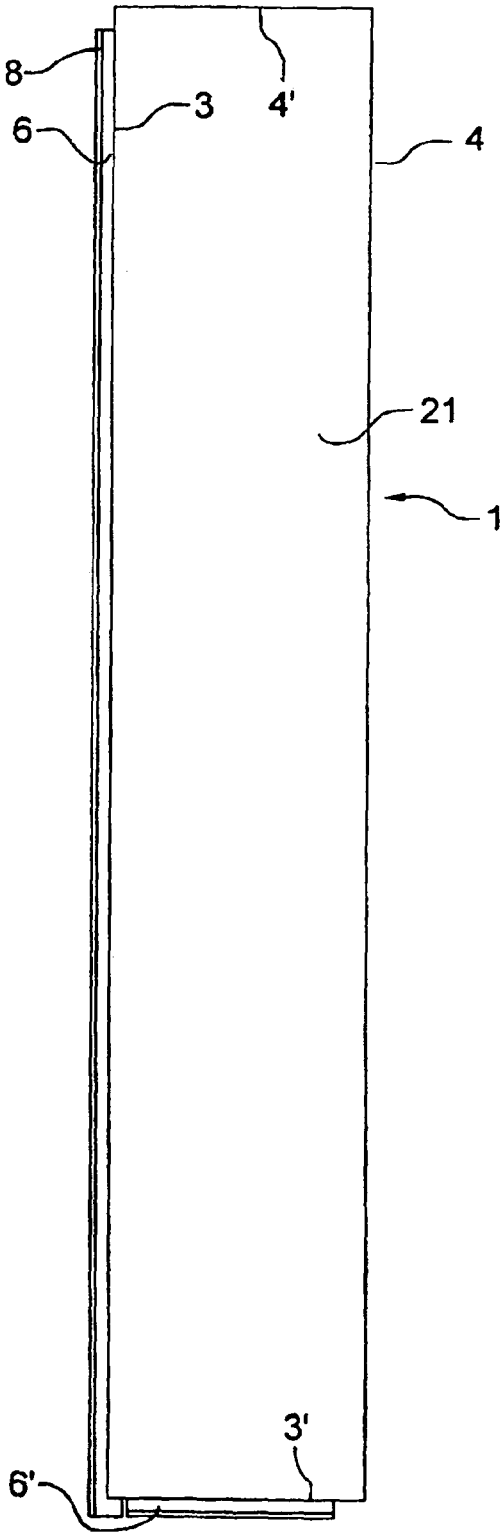

Reference is now made primarily to FIGS. 1*a* and 1*b*, and secondly to FIGS. 4*a* and 4*b* showing the basic design of the floor panels from below and from above, respectively.

From the joint edge 3 of the strip panel 1, i.e. the one long side, projects horizontally a flat strip 6 mounted at the factory on the underside of the strip panel 1 and extending throughout the entire joint edge 3. 15 The strip 6, which is made of flexible, resilient sheet aluminum, can be fixed mechanically, by means of glue or in any other suitable way. In FIGS. 1*a* and 1*b*, the strip 6 is glued, while in FIGS. 4*a* and 4*b* it is mounted by means of a mechanical connection, which will be described in more detail hereinbelow.

Other strip materials can be used, such as sheets of other metals, as well as aluminum or plastics sections. Alternatively, the strip 6 may be integrally formed with the strip panel 1. At any rate, the strip 6 should be integrated with the strip panel 1, i.e. it should not be mounted on the strip panel 1 in connection with laying. As a non-restrictive example, the strip 6 may have a width of about 30 mm and a thickness of about 0.5 mm.

As appears from FIGS. 4*a* and 4*b*, a similar, although a shorter strip 6' is provided also at one short side 3' of the strip panel 1. The shorter strip 6' does however not extend throughout the entire short side 3' but is otherwise identical with the strip 6 and, therefore, is not described in more detail here.

The edge of the strip 6 facing away from the joint edge 3 is formed with a locking element 8 extended throughout the entire strip 6. The locking element 8 has a locking surface 10 facing the joint edge 3 and having a height of e.g. 0.5 mm. The locking element 8 is so designed that when the floor is being laid and the strip panel 2 of FIG. 1*a* is pressed with its joint edge 4 against the joint edge 3 of the strip panel 1 and is angled down against the subfloor 12 according to FIG. 1*b*, it enters a locking groove 14 formed in the underside 16 of the groove panel 2 and extending parallel to and spaced from the joint edge 4. In FIG. 1*b*, the locking element 8 and the locking groove 14 together form a mechanical connection locking the panels 1, 2 to each other in the direction designated D2. More specifically, the locking surface 10 of the locking element 8 serves as a stop with respect to the surface of the locking groove 14 closest to the joint edge 4.

When the panels 1 and 2 are joined together, they can however occupy such a relative position in the direction D2 that there is a small play Δ between the locking surface 10 and the locking groove 14. This mechanical connection in the direction D2 allows mutual displacement of the panels 1, 2 in the direction of the joint, which considerably facilitates the laying and enables joining together the short sides by snap action.

As appears from FIGS. 4*a* and 4*b*, each panel in the system has a strip 6 at one long side 3 and a locking groove 14 at the other long side 4, as well as a strip 6' at one short side 3' and a locking groove 14' at the other short side 4'.

Furthermore, the joint edge 3 of the strip panel 1 has in its underside 18 a recess 20 extending throughout the entire joint edge 3 and forming together with the upper face 22 of the strip 6 a laterally open recess 24. The joint edge 4 of the groove panel 2 has in its top side 26 a corresponding recess 28 forming a locking tongue 30 to be accommodated in the recess 24 so as to form a mechanical connection locking the joint edges 3, 4 to each other in the direction designated D1. This connection can be achieved with other designs of the joint edges 3, 4, for example by a bevel thereof such that the joint edge 4 of the groove panel 2 passes obliquely in underneath the joint edge 3 of the strip panel 1 to be locked between that edge and the strip 6.

The panels 1, 2 can be taken up in the reverse order of laying without causing any damage to the joint, and be laid again.

The strip 6 is mounted in a tolerance-equalizing groove 40 in the underside 18 of the strip panel 1 adjacent the joint edge 3. In this embodiment, the width of the equalizing groove 40 is approximately equal to half the width of the strip 6, i.e. about 15 mm. By means of the equalizing groove 40, it is ensured that there will always exist between the top side 21 of the panel 1 and the bottom of the groove 40 an exact, predetermined distance E which is slightly smaller than the minimum thickness (2.8 mm) of the floor panels 1, 2. The groove panel 2 has a corresponding tolerance-equalizing surface or groove 42 in the underside 16 of the joint edge 4. The distance between the equalizing surface 42 and the top side 26 of the groove panel 2 is equal to the aforementioned exact distance E. Further, the thickness of the strip 6 is so chosen that the underside 44 of the strip is situated slightly below the undersides 18 and 16 of the floor panels 1 and 2, respectively. In this manner, the entire joint will rest on the strip 6, and all vertical downwardly-directed forces will be efficiently transmitted to the subfloor 12 without any stresses being exerted on the joint edges 3, 4. Thanks to the provision of the equalizing grooves 40, 42, an entirely even joint will be achieved on the top side, despite the thickness tolerances of the panels 1, 2, without having to perform any grinding or the like across the whole panels. Especially, this obviates the risk of damage to the bottom layer of the compact laminate, which might give rise to bulging of the panels.

Figure 2A:
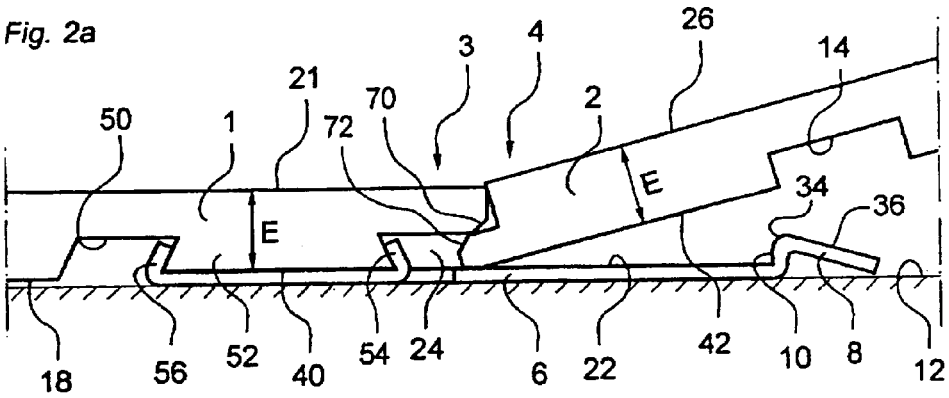
Figure 2B:
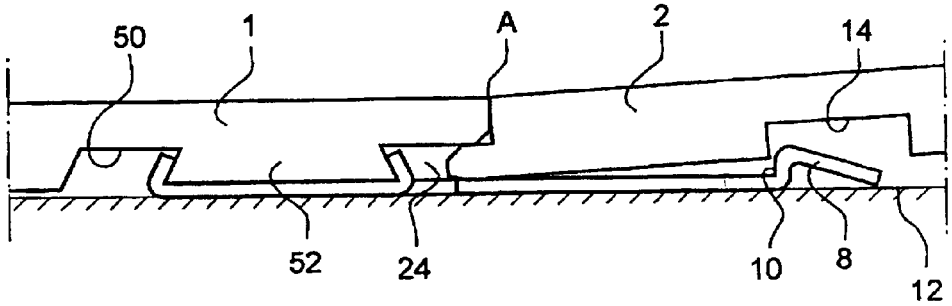
Figure 2C:
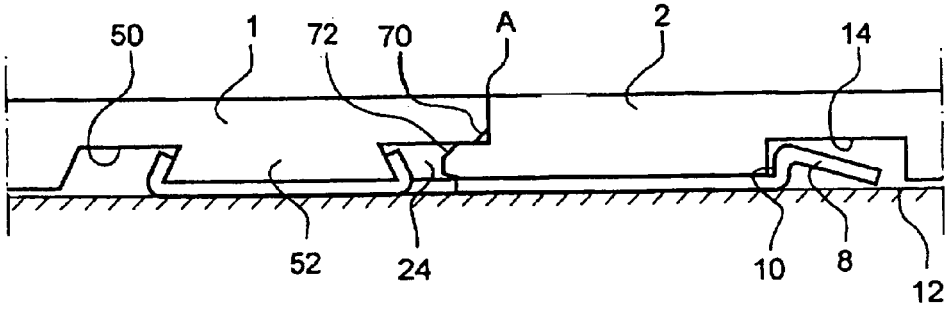

Reference is now made to the embodiment of FIGS. 2*a-c* showing in a succession substantially the same laying method as in FIGS. 1*a* and 1*b*. The embodiment of FIGS. 2*a-c* primarily differs from the embodiment of FIGS. 1*a* and 1*b* in that the strip 6 is mounted on the strip panel 1 by means of a mechanical connection instead of glue. To provide this mechanical connection, illustrated in more detail in FIG. 6, a groove 50 is provided in the underside 18 of the strip panel 1 at a distance from the recess 24. The groove 50 may be formed either as a continuous groove extending throughout the entire length of the panel 1, or as a number of separate grooves. The groove 50 defines, together with the recess 24, a dovetail gripping edge 52, the underside of which exhibits an exact equalizing distance E to the top side 21 of the strip panel 1. The aluminum strip 6 has a number of punched and bent tongues 54, as well as one or more lips 56 which are bent round opposite sides of the gripping edge 52 in clamping engagement therewith. This connection is shown in detail from below in the perspective view of FIG. 6.

Figure 7:
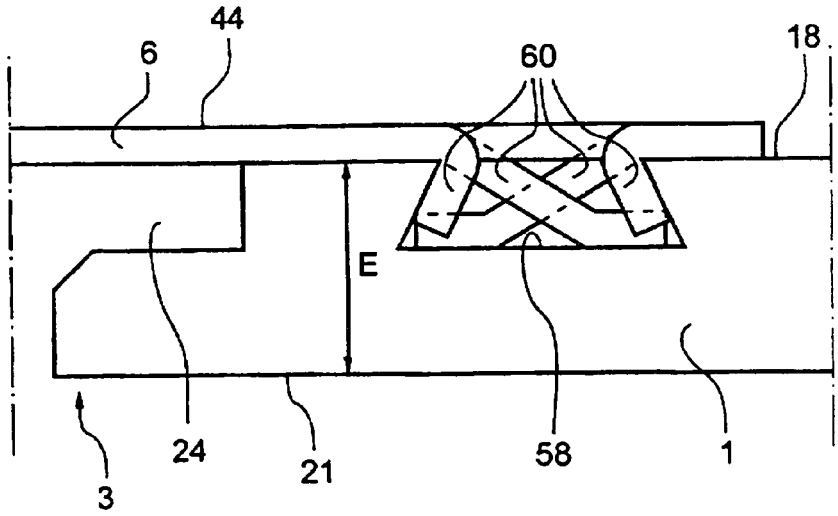
FIG. 7 shows in section a second variant for mounting a strip on a floor panel.

Alternatively, a mechanical connection between the strip 6 and the strip panel 1 can be provided as illustrated in FIG. 7 showing in section a cut-away part of the strip panel 1 turned upside down. In FIG. 7, the mechanical connection comprises a dovetail recess 58 in the underside 18 of the strip panel 1, as well as tongues/lips 60 punched and bent from the strip 6 and clamping against opposing inner sides of the recess 58.

The embodiment of FIGS. 2*a-c* is further characterized in that the locking element 8 of the strip 6 is designed as a component bent from the aluminum sheet and having an operative locking surface 10 extending at right angles up from the front side 22 of the strip 6 through a height of e.g. 0.5 mm, and a rounded guide surface 34 facilitating the insertion of the locking element 8 into the locking groove 14 when angling down the groove panel 2 towards the subfloor 12 (FIG. 2*b*), as well as a portion 36 which is inclined towards the subfloor 12 and which is not operative in the laying method illustrated in FIGS. 2*a-c*.

Further, it can be seen from FIGS. 2*a-c* that the joint edge 3 of the strip panel 1 has a lower bevel 70 which cooperates during laying with a corresponding upper bevel 72 of the joint edge 4 of the groove panel 2, such that the panels 1 and 2 are forced to move vertically towards each other when their joint edges 3, 4 are moved up to each other and the panels are pressed together horizontally.

Preferably, the locking surface 10 is so located relative to the joint edge 3 that when the groove panel 2, starting from the joined position in FIG. 2*c*, is pressed horizontally in the direction D2 against the strip panel 1 and is turned angularly up from the strip 6, the maximum-distance between the axis of rotation A of the groove panel 2 and the locking surface 10 of the locking groove is such that the locking element 8 can leave the locking groove 14 without coming into contact with it.

Figure 3A:
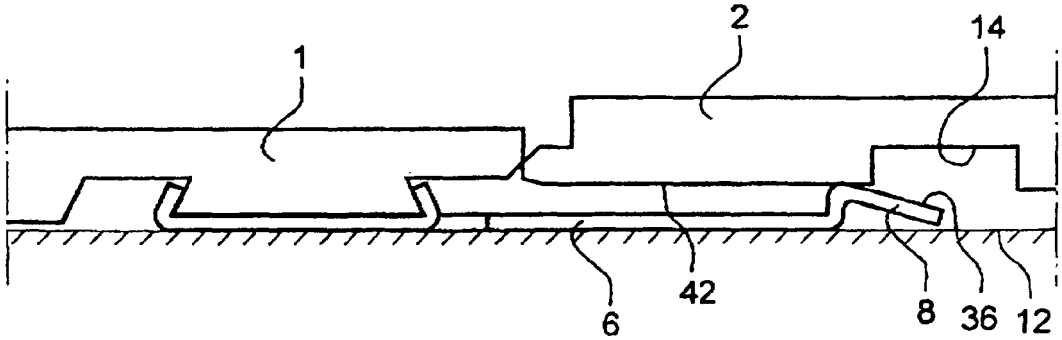
Figure 3B:
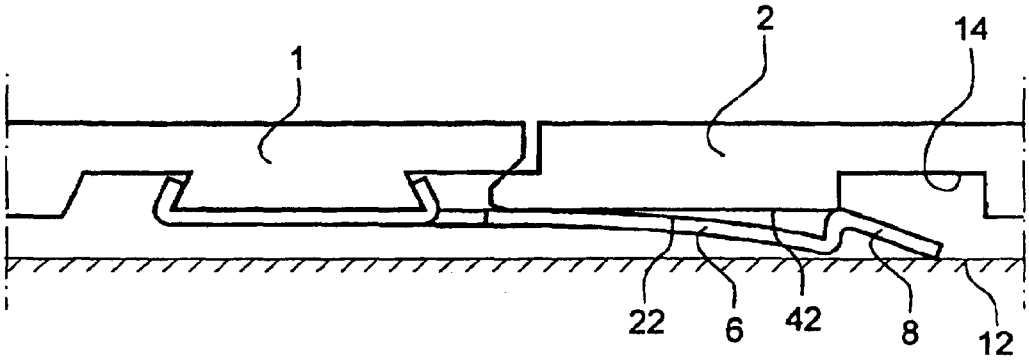
Figure 3C:
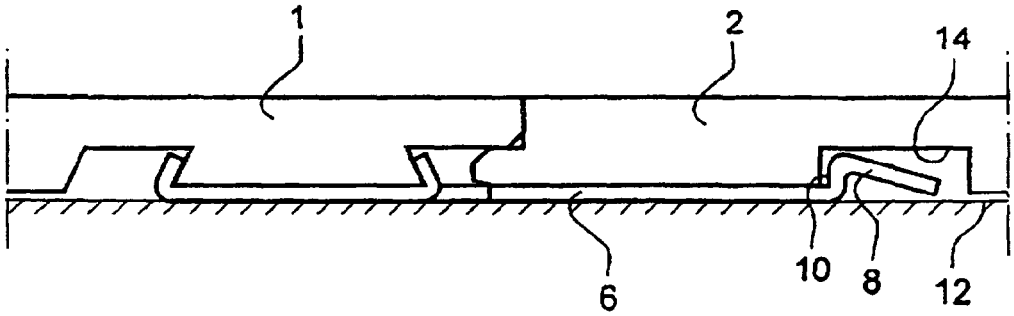

FIGS. 3*a*-3*b* show another joining method for mechanically joining together the floor panels of FIGS. 2*a-c*. The method illustrated in FIGS. 3*a-c* relies on the fact that the strip 6 is resilient and is especially useful for joining together the short sides of floor panels which have already been joined along one long side as illustrated in FIGS. 2*a-c*. The method of FIGS. 3*a-c* is performed by first placing the two panels 1 and 2 flat on the subfloor 12 and then moving them horizontally towards each other according to FIG. 3*b*. The inclined portion 36 of the locking element 8 then serves as a guide surface which guides the joint edge 4 of the groove panel 2 up on to the upper side 22 of the strip 6. The strip 6 will then be urged downwards while the locking element 8 is sliding on the equalizing surface 42. When the joint edges 3, 4 have been brought into complete engagement with each other horizontally, the locking element 8 will snap into the locking groove 14 (FIG. 3*c*), thereby providing the same locking as in FIG. 2*c*. The same locking method can also be used by placing, in the initial position, the joint edge 4 of the groove panel with the equalizing groove 42 on the locking element 10 (FIG. 3*a*). The inclined portion 36 of the locking element 10 then is not operative. This technique thus makes it possible to lock the floor panels mechanically in all directions, and by repeating the laying operations the whole floor can be laid without using any glue.

The invention is not restricted to the preferred embodiments described above and illustrated in the drawings, but several variants and modifications thereof are conceivable within the scope of the appended claims. The strip 6 can be divided into small sections covering the major part of the joint length. Further, the thickness of the strip 6 may vary throughout its width. All strips, locking grooves, locking elements and recesses are so dimensioned as to enable laying the floor panels with flat top sides in a manner to rest on the strip 6 in the joint. If the floor panels consist of compact laminate and if silicone or any other sealing compound, a rubber strip or any other sealing device is applied prior to laying between the flat projecting part of the strip 6 and the groove panel 2 and/or in the recess 26, a moisture-proof floor is obtained.

Figure 6:
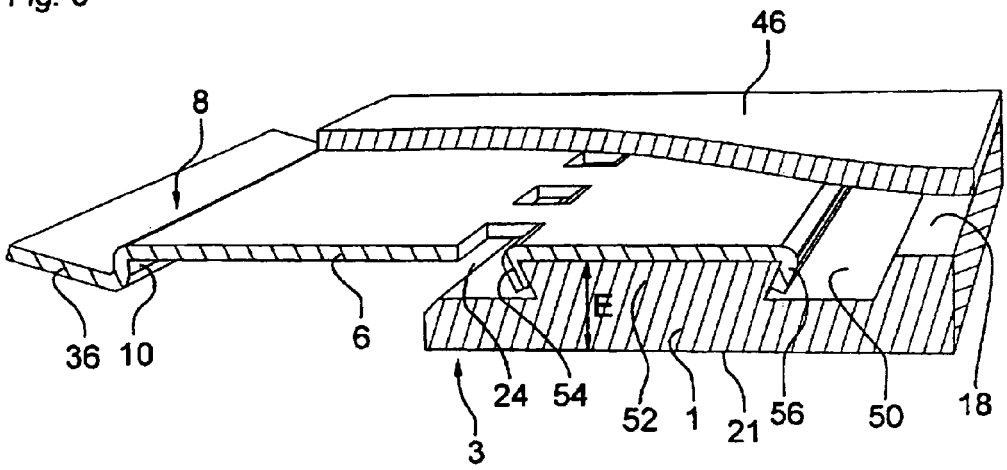
FIG. 6 shows in perspective and from below a first variant for mounting a strip on a floor panel.

As appears from FIG. 6, an underlay 46, e.g. of floor board, foam or felt, can be mounted on the underside of the panels during the manufacture thereof. In one embodiment, the underlay 46 covers the strip 6 up to the locking element 8, such that the joint between the underlays 46 becomes offset in relation to the joint between the joint edges 3 and 4.

Figure 5:
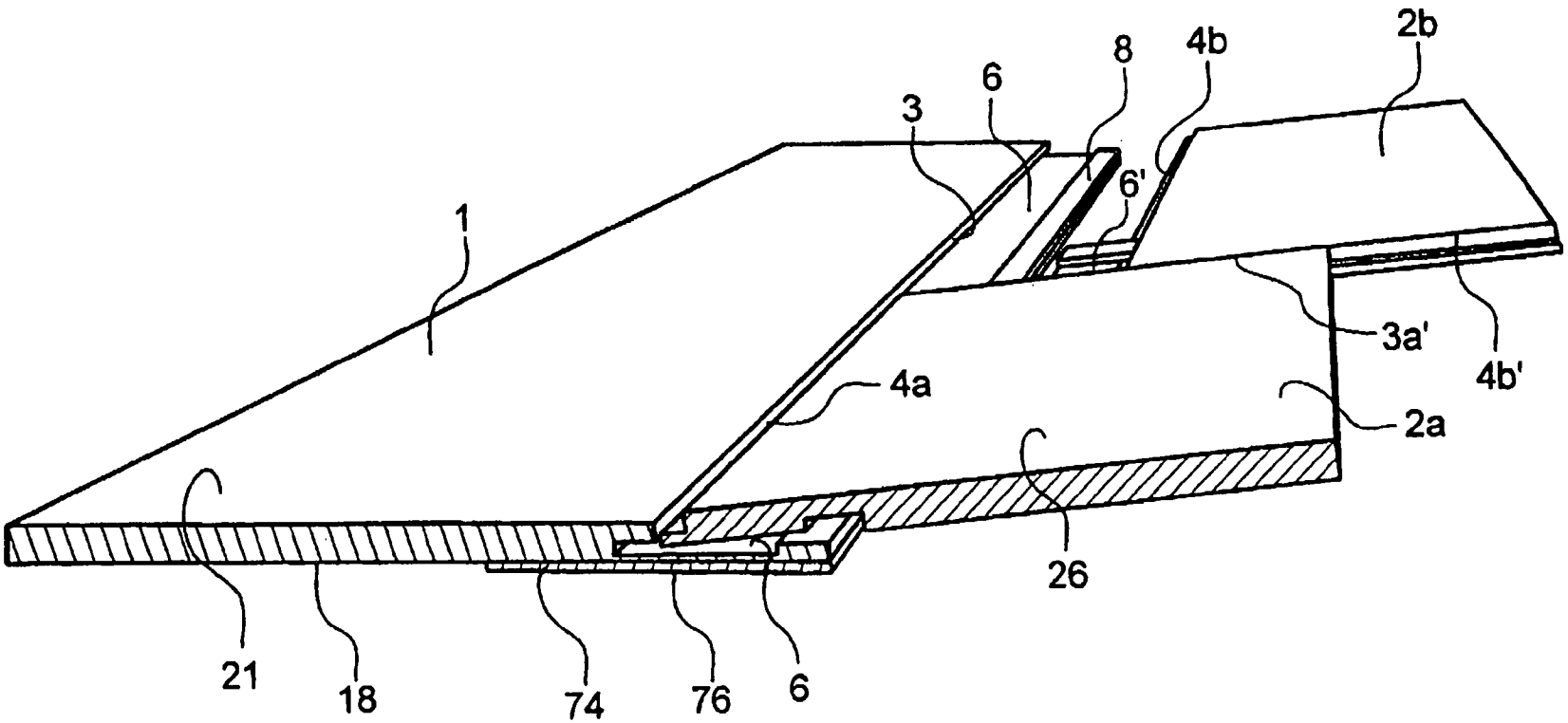
FIG. 5 illustrates in perspective a method for laying and joining floor panels according to a third embodiment of the invention.

In the embodiment of FIG. 5, the strip 6 and its locking element 8 are integrally formed with the strip panel 1, the projecting part of the strip 6 thus forming an extension of the lower part of the joint edge 3. The locking function is the same as in the embodiments described above. On the underside 18 of the strip panel 1, there is provided a separate strip, band or the like 74 extending throughout the entire length of the joint and having, in this embodiment, a width covering approximately the same surface as the separate strip 6 of the previous embodiments. The strip 74 can be provided directly on the rear side 18 or in a recess formed therein (not shown), so that the distance from the front side 21, 26 of the floor to the rear side 76, including the thickness of the strip 74, always is at least equal to the corresponding distance in the panel having the greatest thickness tolerance. The panels 1, 2 will then rest, in the joint, on the strip 74 or only on the undersides 18, 16 of the panels, if these sides are made plane.

When using a material which does not permit downward bending of the strip 6 or the locking element 8, laying 20 can be performed in the way shown in FIG. 5. A floor panel 2*a* is moved angled upwardly with its long side 4*a* into engagement with the long side 3 of a previously laid floor panel 1 while at the same time a third floor panel 2*b* is moved with its short side 4*b*' into engagement with the short side 3*a*' of the upwardly-angled floor panel 2*a* and is fastened by angling the panel 2*b* downwards. The panel 2*b* is then pushed along the short side 3*a*' of the upwardly-angled floor panel 2*a* until its long side 4*b* encounters the long side 3 of the initially-laid panel 1. The two upwardly-angled panels 2*a* and 2*b* are therefore angled down on to the subfloor 12 so as to bring about locking.

By a reverse procedure the panels can be taken up in the reverse order of laying without causing any damage to the joint, and be laid again.

Several variants of preferred laying methods are conceivable. For example, the strip panel can be inserted under the groove panel, thus enabling the laying of panels in all four directions with respect to the initial position.

What is claimed is:

1. Floorboards with substantially planar and parallel upper top sides and lower undersides and core material located between the upper and lower sides, and a mechanical locking system for locking a first edge of a first floorboard to a second edge of a substantially identical second floorboard, the mechanical locking system comprising:

a tongue on the first edge;

a groove on the second edge, the groove comprising an upper wall, a lower wall opposing the upper wall, and side wall connecting the upper wall and the lower wall;

the tongue and groove forming a first mechanical connection locking the first and second edges to each other in a first direction at right angles to a principal plane of the floor boards, the tongue and groove being formed in the core material which is located between said upper top side and lower underside; and a locking device arranged on the underside of the first and the second edges, the locking device forming a second mechanical connection locking the first and the second edges to each other in a second direction parallel to the principal plane and at right angles to the edges;

the locking device includes a locking groove which extends parallel to and spaced from an upper part of the first edge, the locking groove being formed in the core material and being open at the underside of the floorboard and including an internal surface;

the locking device further includes a strip extending distally beyond an upper part of the second edge, the strip extending throughout substantially an entire length of the second edge and being provided with a locking element projecting from the strip;

wherein the strip, the locking element, and the locking groove are configured such that when the first edge is pressed against an upper part of the second edge and is then angled down, the locking element can enter the locking groove;

the locking element has a locking surface which faces the second edge and is configured so as to contact the internal surface of the locking groove to prevent substantial separation of the first and second edges when joined together;

an uppermost part of the top surface of the locking element is at a different height than the lower wall of the groove; and wherein, when the first edge and the second edge are locked together, there is a space in the locking system between the first and the second floorboards, wherein there is at least a space between an upper part of the tongue and the upper top side of the floorboard.

2. The floorboards as claimed in claim 1, wherein the tongue has a tip, and there is at least a space at least between the tip of the tongue and an inner part of the groove.

3. The floorboards as claimed in claim 2, wherein a small play exists between the locking surface and the locking groove allowing displacement of locked floorboards along the joined edges.

4. The floorboards as claimed in claim 1, wherein there is at least a space between the locking element and the locking groove.

5. The floorboards as claimed in claim 4, wherein the locking element further includes an outer portion which is most distant to the joined edges and the space between said locking element and the locking groove is between said outer portion and the locking groove.

6. The floorboards as claimed in claim 1, wherein the tongue has a tip, and there is an additional space at least between the tip of the tongue and an upper part of the groove.

7. The floorboards as claimed in claim 6, wherein there is an additional space between the locking element and the locking groove.

8. The floorboards as claimed in claim 7, wherein a thickness of the strip varies throughout its width.

9. The floorboards as claimed in claim 1, wherein the locking element has a guide surface at an upper part thereof facilitating insertion of the locking element into the locking groove.

10. The floorboards as claimed in claim 1, wherein the floor board and the second floor board form a laminated floor.

11. Floorboards with substantially planar and parallel upper top sides and lower undersides and core material located between the upper and lower sides, and a mechanical locking system for locking a first edge of a first floorboard to a second edge of a substantially identical second floorboard, the mechanical locking system comprising:

a tongue on the first edge;

a groove on the second edge, the groove comprising an upper wall, a lower wall opposing the upper wall, and side wall connecting the upper wall and the lower wall;

the tongue and groove forming a first mechanical connection locking the first and second edges to each other in a first direction at right angles to a principal plane of the floor boards, the tongue and groove being formed in the core material which is located between said upper top side and lower underside; and a locking device arranged on the underside of the first and the second edges, the locking device forming a second mechanical connection locking the first and the second edges to each other in a second direction parallel to the principal plane and at right angles to the edges;

the locking device includes a locking groove which extends parallel to and spaced from an upper part of the first edge, the locking groove being formed in the core material and being open at the underside of the floorboard and including an internal surface;

the locking device further includes a strip extending distally beyond an upper part of the second edge, the strip extending throughout substantially an entire length of the second edge and being provided with a locking element projecting from the strip;

wherein the strip, the locking element, and the locking groove are configured such that when the first edge is pressed against an upper part of the second edge and is then angled down, the locking element can enter the locking groove;

the locking element has a locking surface which faces the second edge and is configured so as to contact the internal surface of the locking groove to prevent substantial separation of the first and second edges when joined together;

an uppermost part of the top surface of the locking element is at a different height than the lower wall of the groove; and wherein, when the first edge and the second edge are locked together, there is a space in the locking system between the first and the second floorboards, wherein there is at least a space between the locking element and the locking groove, wherein the space between the locking element and the locking groove is above the upper part of the locking element.

12. A floating laminate floorboard comprising an upper decorative wear layer; a core layer arranged beneath the upper decorative wear layer, the core layer being made of a material that is not as hard as the upper decorative wear layer; the floorboard having a substantially planar upper top side and a substantially planar lower underside that is substantially parallel to the upper top side; first and second edges; a panel material which is located between said upper top side and the lower underside; and a mechanical locking system for locking the first edge of the floorboard to a second edge of a substantially identical second floorboard, the mechanical locking system comprising:

a tongue on the first edge;

a groove on the second edge, the groove comprising an upper wall, a lower wall opposing the upper wall, and side wall connecting the upper wall and the lower wall;

the tongue and groove forming a first mechanical connection locking the first and second edges to each other in a first direction at right angles to a principal plane of the floorboards, the tongue and groove being formed in the panel material which is located between said upper top side and the lower underside;

a locking device arranged on the underside of the first and the second edges, the locking device forming a second mechanical connection locking the first and the second edges to each other in a second direction parallel to the principal plane and at right angles to the edges;

the locking device includes a locking groove which extends parallel to and spaced from an upper part of the first edge, the locking groove being formed in the floorboard and being open at an underside of the floorboard and including an internal surface;

the locking device further includes a strip extending distally beyond an upper part of the second edge, the strip extending throughout substantially an entire length of the second edge and being provided with a locking element projecting from the strip;

wherein the strip, the locking element, and the locking groove are configured such that when the first edge is pressed against an upper part of the second edge and is then angled down, the locking element can enter the locking groove;

wherein the locking element has a locking surface which faces the second edge and is configured so as to contact the internal surface of the locking groove to prevent substantial separation of the joined first and second edges;

wherein an uppermost part of the top surface of the locking element is at a different height than the lower wall of the groove; and wherein when the floorboard is locked to the second floorboard, there are spaces in the locking system in the following areas:

between an upper part of the tongue and the upper side of the floorboard;

between a tip of the tongue and an inner part of the groove; and between the locking element and the locking groove.

13. The laminate floorboard as claimed in claim 12, wherein the groove is wider at an outer part than at an inner part.

14. The laminate floorboard as claimed in claim 13, wherein an inner part of the tongue adjacent to the first edge is thicker than a distal outer part of the tongue.

15. The laminate floorboard as claimed in claim 12, wherein a thickness of the strip varies as the strip extends from the second edge.

16. The laminate floorboard as claimed in claim 15, wherein an inner part of the tongue adjacent to the first edge is thicker than a distal outer part of the tongue.

17. The laminate floorboard as claimed in claim 12, wherein an inner part of the tongue adjacent to the first edge is thicker than a distal outer part of the tongue.

18. The laminate floorboard as claimed in claim 12, wherein the strip has an outwardly inclined outer portion.

19. The laminate floorboard as claimed in claim 12, wherein the strip is flexible and resilient such that the first and second edges can be mechanically joined together by displacing said first and second edges horizontally towards each other, while resiliently urging the flexible strip of said second edge downwards until said adjacent first and second edges have been brought into complete engagement with each other horizontally and the locking element at said second edge thereby snaps into the locking groove at the first edge.

20. The laminate floorboard as claimed in claim 12, wherein a small play exists between the locking surface and the locking groove allowing displacement of locked floorboards along the joint edges.

21. The laminate floorboard as claimed in claim 12, wherein the tongue has a tip, and there is an additional space at least between the tip of the tongue and an inner part of the groove.

22. The laminate floorboard as claimed in claim 12, wherein the tongue has a tip, and there is an additional space at least between the tip of the tongue and an upper part of the groove.

23. The laminate floorboard as claimed in claim 12, wherein the tongue has a tip, and there is an additional space at least between the tip of the tongue and the lower part of the groove.

24. The laminate floorboard as claimed in claim 12, wherein the space between the locking element and the locking groove is above an upper part of the locking element.

25. The laminate floorboard as claimed in claim 12, wherein the locking element further includes an outer portion which is most distant to the joined edges and the space between said locking element and the locking groove is between said outer portion and the locking groove.

* * * * *